US007124971B2

(12) United States Patent
Sugimura et al.

(10) Patent No.: US 7,124,971 B2
(45) Date of Patent: Oct. 24, 2006

(54) JAW CRUSHER

(75) Inventors: Makoto Sugimura, Hirakata (JP); Ryoichi Togashi, Hirakata (JP); Kouzou Suzuki, Hirakata (JP)

(73) Assignee: Komatsu Ltd., Tokyo (JP)

( * ) Notice: Subject to any disclaimer, the term of this patent is extended or adjusted under 35 U.S.C. 154(b) by 168 days.

(21) Appl. No.: 10/719,032

(22) Filed: Nov. 20, 2003

(65) Prior Publication Data

US 2004/0124295 A1 Jul. 1, 2004

(30) Foreign Application Priority Data

Nov. 28, 2002 (JP) ..... 2002-346472

(51) Int. Cl.
*B02C 1/02* (2006.01)

(52) U.S. Cl. ..... 241/269

(58) Field of Classification Search ..... 241/264–269, 241/37, 34, 36

See application file for complete search history.

(56) References Cited

U.S. PATENT DOCUMENTS

| | | | |
|---|---|---|---|
| 1,620,078 | A | 3/1927 | Cookinham |
| 2,259,833 | A | 10/1941 | Sandy |
| 3,918,648 | A | 11/1975 | Anthony |
| 4,361,289 | A | 11/1982 | Georget et al. |
| 5,765,769 | A | 6/1998 | Kaya |
| 6,375,105 | B1 | 4/2002 | Haven et al. |
| 2002/0036246 | A1 | 3/2002 | Togashi et al. |
| 2004/0129815 | A1 | 7/2004 | Togashi et al. |

FOREIGN PATENT DOCUMENTS

| | | | |
|---|---|---|---|
| DE | 199 56 200 | A1 | 6/2001 |
| EP | 0 642 832 | A1 | 3/1995 |
| EP | 0 826 421 | A2 | 3/1998 |
| FR | 1 348 462 | | 4/1964 |
| GB | 970754 | | 9/1964 |
| JP | 57-110340 | A | 7/1982 |
| JP | 5-45300 | B2 | 7/1993 |
| JP | 3133766 | B2 | 11/2000 |
| WO | WO 02/34393 | A1 | 5/2002 |

*Primary Examiner*—Mark Rosenbaum
(74) *Attorney, Agent, or Firm*—Frishauf, Holtz, Goodman & Chick, P.C.

(57) ABSTRACT

A jaw crusher capable of stable angle detection is provided. For this purpose, the jaw crusher includes a fixed jaw (35), a swing jaw (36) provided to oppose the fixed jaw, a frame (34) for supporting the fixed jaw and the swing jaw, and an outlet clearance adjusting mechanism (62) for adjusting an outlet clearance between the fixed jaw and the swing jaw, and the outlet clearance adjusting mechanism includes a connecting member (61) of which one end is made abut to or connected to the swing jaw, a rotatable rotary member (64) which is made abut to or connected to the other end of the connecting member, a driving mechanism (65) for rotating the rotary member, and angle detecting equipment (69) which is mounted to the frame and detects a rotation angle of the rotary member.

4 Claims, 11 Drawing Sheets

JAW CRUSHER

TECHNICAL FIELD

The present invention relates to a jaw crusher which crushes raw materials by moving a pair of jaws close to and away from each other.

BACKGROUND ART

A jaw crusher, which crushes raw materials by moving a swing jaw close to and away from a stationary jaw, has been conventionally known (for example, Japanese Patent Publication No. 5-45300, especially, pages 1 to 3, and FIG. 1 and FIG. 2). In this jaw crusher, the grain size of a crushed product is determined by an outlet clearance between lower ends of the stationary jaw and the swing jaw, and an outlet clearance adjustment mechanism is provided so as to make the outlet clearance adjustable. The outlet clearance adjustment mechanism includes a toggle plate of which one end is made abut to the swing jaw, and a toggle block to which the other end of the toggle plate is made abut, and the outlet clearance adjustment mechanism is constituted by constituting the toggle block in a link shape and rotatably supporting it. When the toggle block is rotated, the swing jaw is moved close to and away from the fixed jaw via the toggle plate, and the outlet clearance between the lower ends of the swing jaw and the stationary jaw can be adjusted. In this outlet clearance adjustment mechanism, an angular sensor or the like is provided at a rotary shaft of the toggle block so that the outlet clearance can be detected according to an amount of rotation of the toggle block.

However, the outlet clearance adjustment mechanism including the toggle block usually also plays the role of a reaction force receiving mechanism which receives a reaction force from the swing jaw which is crushing. Consequently, the angle sensor, which is mounted to the toggle block, causes the problem that the angle sensor is vibrated by a reaction force which is repeatedly exerted on the toggle plate and the toggle block from the swing jaw, an impact at the time of crushing and the like, and thus it cannot detect the angle with stability. In addition, there exists the problem that a sensor with high resolution is expensive.

SUMMARY OF THE INVENTION

The present invention is made to solve the problems of the above prior art, and has its object to provide a jaw crusher capable of stable angle detection.

For this purpose, a jaw crusher according to the present invention has the constitution in which it includes: a fixed jaw; a swing jaw provided to oppose the fixed jaw; a frame for supporting the fixed jaw and the swing jaw; and an outlet clearance adjusting mechanism for adjusting an outlet clearance between the fixed jaw and the swing jaw; and the outlet clearance adjusting mechanism includes a connecting member of which one end is made abut to or connected to the swing jaw, a rotatable rotary member which is made abut to or connected to the other end of the connecting member, a driving mechanism for rotating the rotary member, and angle detecting equipment which is mounted to the frame and detects a rotation angle of the rotary member.

According to the above constitution, the angle detecting equipment for detecting the rotation angle of the rotary member is mounted to the frame, and therefore it does not directly receive a repeated reaction force from the swing jaw and impacts and the like at the time of crushing. Accordingly, the angle detecting equipment hardly receives the vibration of the rotary member by the reaction force and the like from the swing jaw, unlike the case in which the angle sensor is conventionally mounted to the toggle block, and therefore a detection signal of the angle detecting equipment is stabilized.

In the jaw crusher, the angle detecting equipment may be connected to the rotary member with a link. According to this constitution, the angle detecting equipment is connected with the link, and therefore the length, the mounting position and the like of the link are optionally set unlike the case in which the angle detecting equipment is conventionally fixed to the rotary shaft. Accordingly, an amount of rotation of the rotary member is easily amplified, and resolution becomes higher, which makes finer and more accurate angle detection possible, thus making it possible to obtain a crushed product of a desired grain size.

BEST MODE FOR CARRYING OUT THE INVENTION

[Brief Explanation of Entire Constitution]

Figure 1:
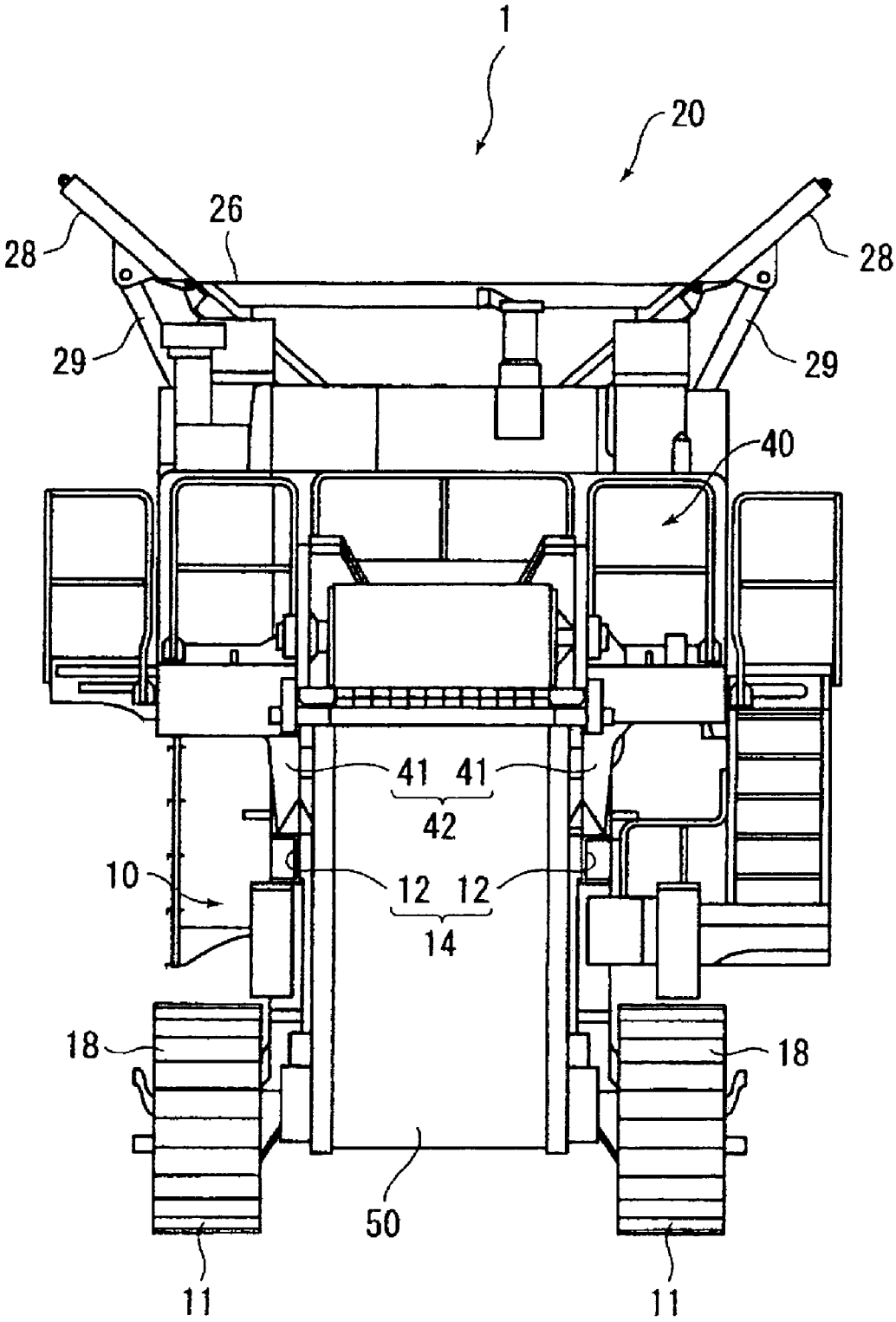
FIG. 1 is a front view showing a self-propelled crusher in one embodiment of the present invention.
Figure 2:
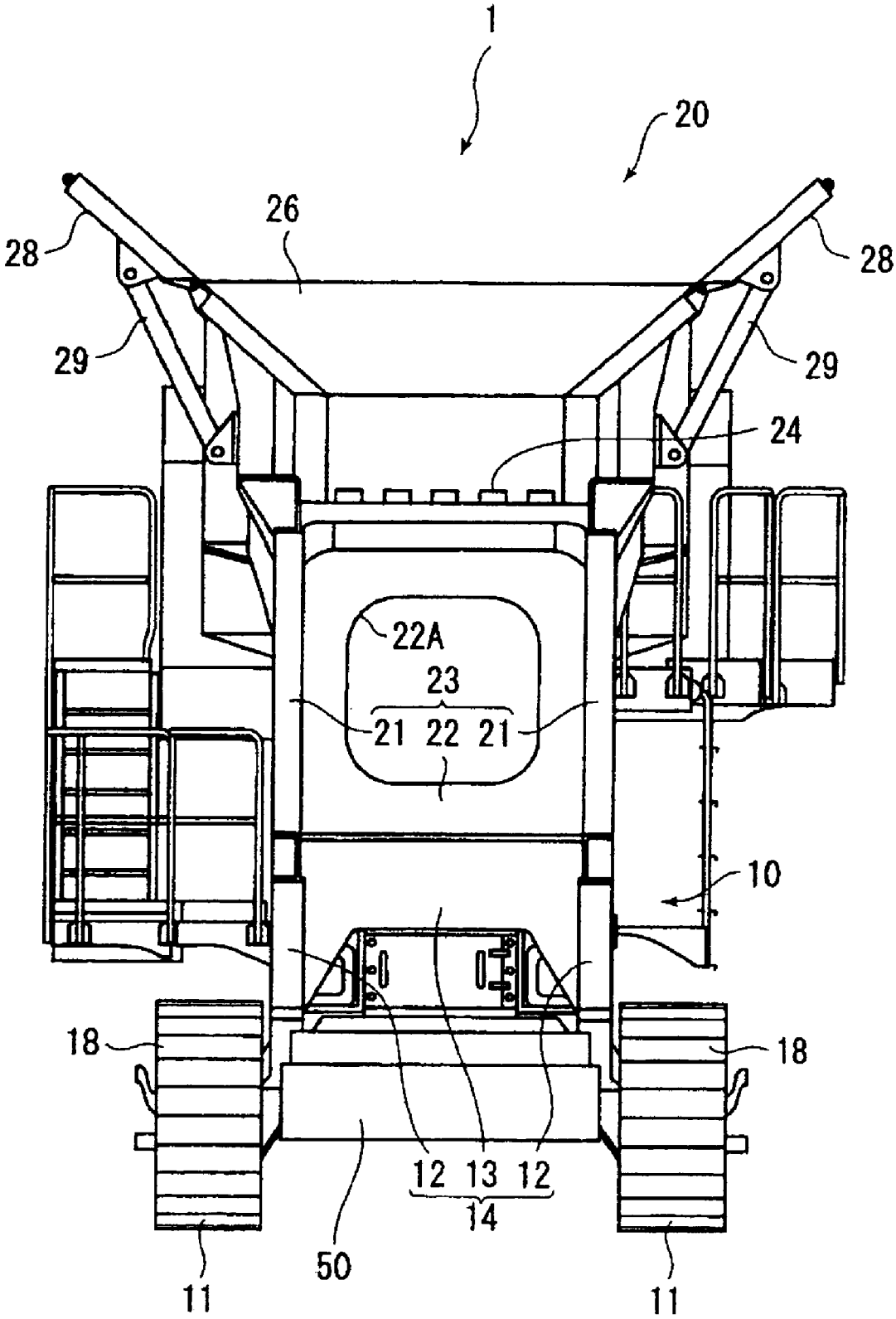
FIG. 2 is a rear view showing the self-propelled crusher in FIG. 1.
Figure 3:
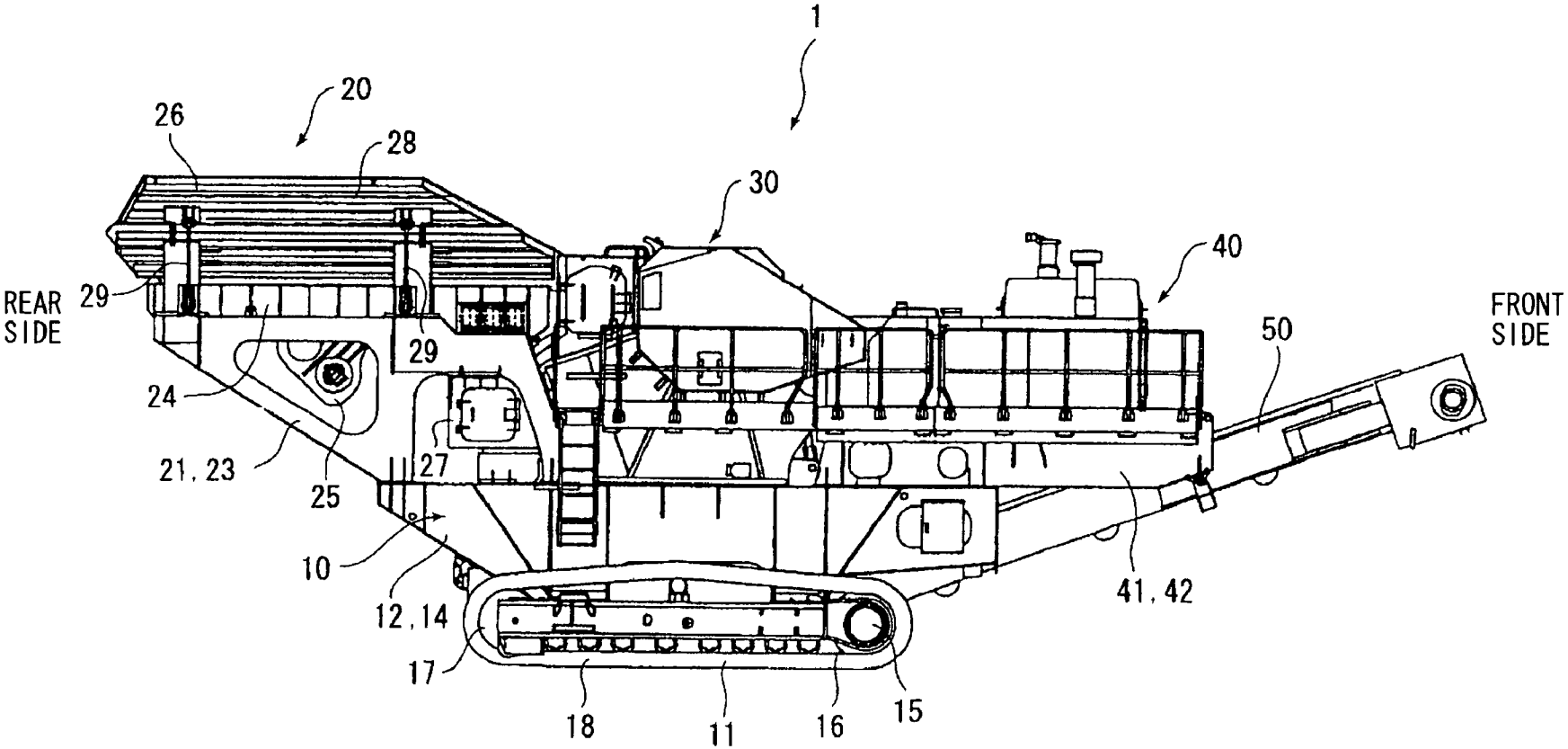
FIG. 3 is a right side view showing the self-propelled crusher in FIG. 1.
Figure 4:
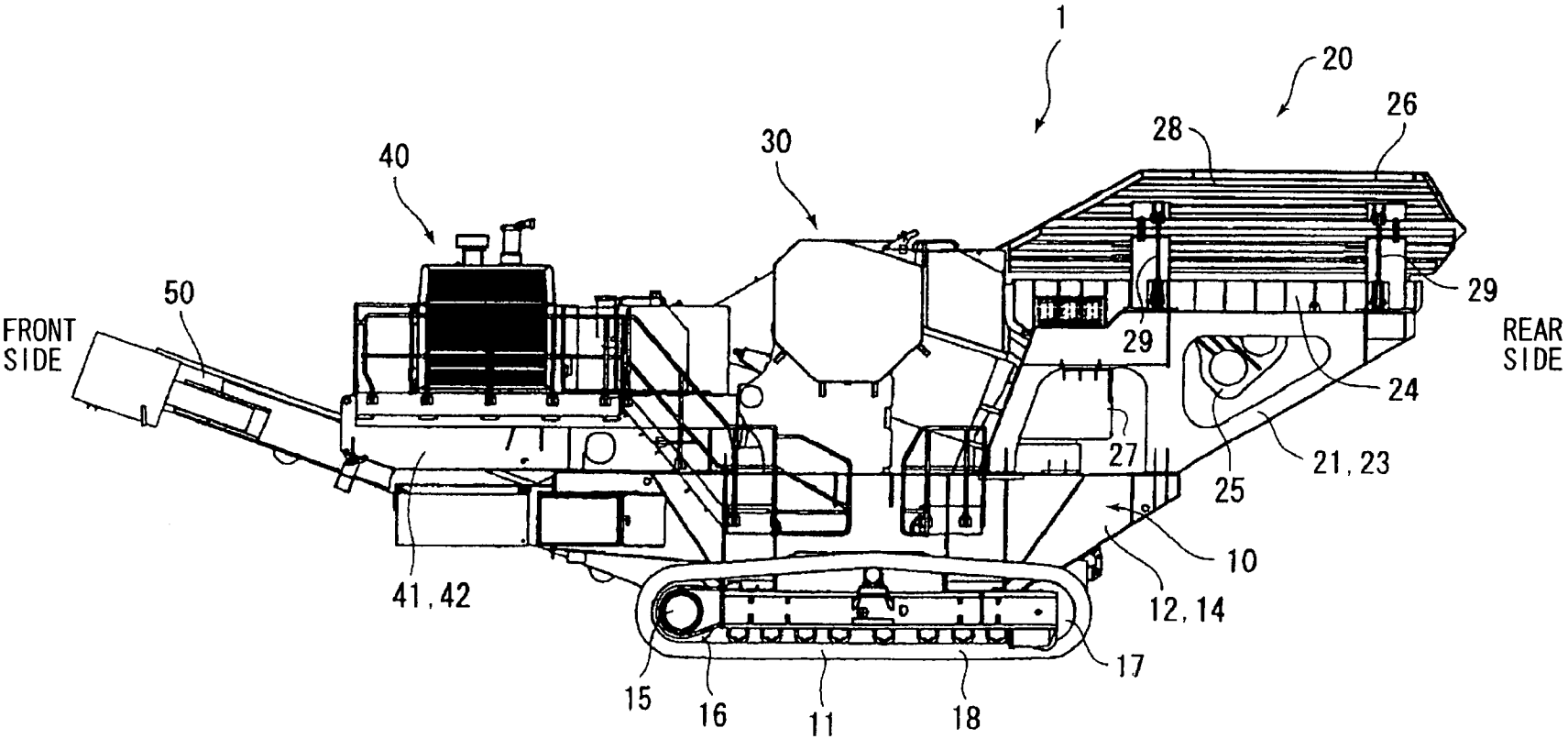
FIG. 4 is a left side view showing the self-propelled crusher in FIG. 1.
Figure 5:
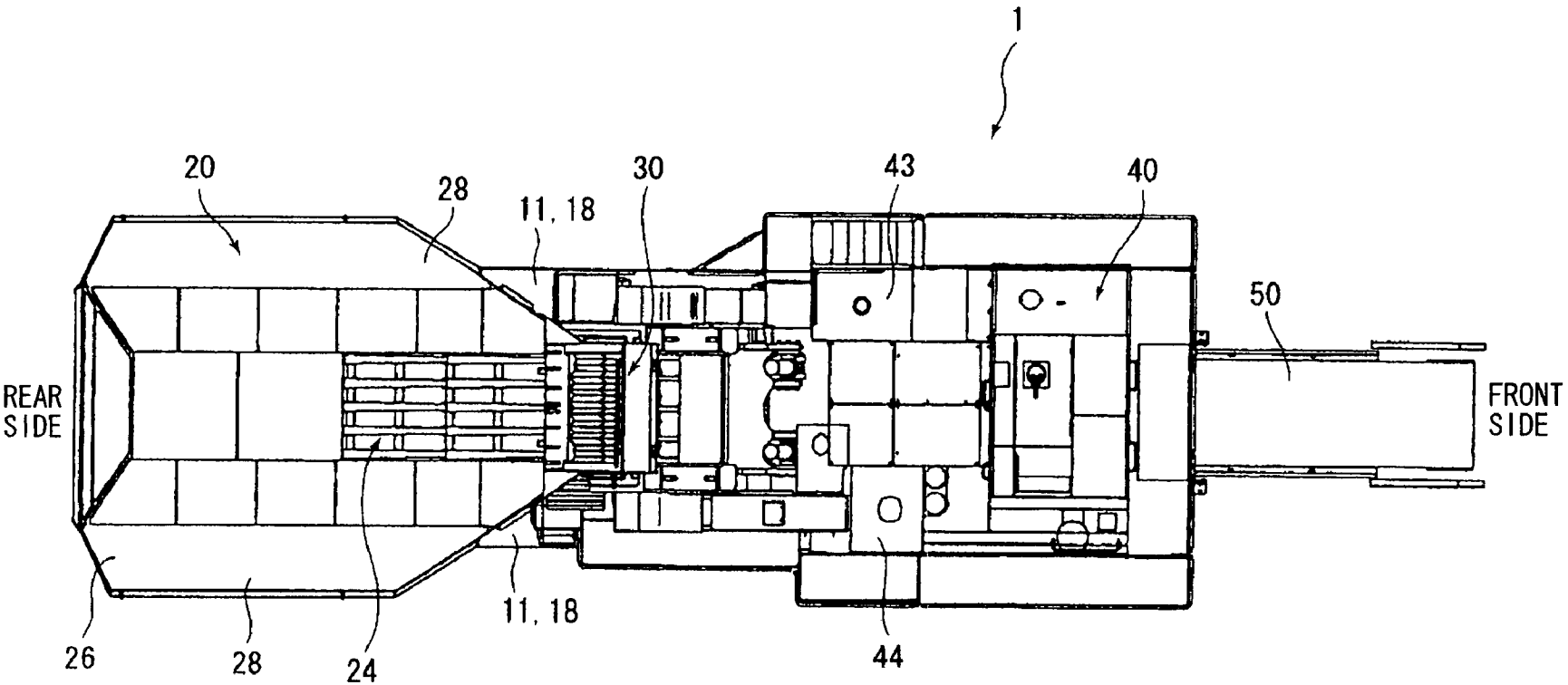
FIG. 5 is a plan view of the self-propelled crusher in FIG. 1.

A preferred embodiment of the present invention will be explained below based on the drawings. FIG. 1 to FIG. 5 are a front view, a rear view, a right side view, a left side view and a plan view showing a self-propelled crusher 1 according to this embodiment. In this embodiment, the right side in FIG. 3 is assumed to be a front side, and the left side is assumed to be a rear side for convenience of explanation. The self-propelled crusher 1 is sometimes disposed in a building demolishing site or the like and used for crushing concrete lumps and asphalt lumps, but in this embodiment, it is exclusively disposed in a mine and a stone crushing site and used for roughly crushing large rocks and stones and natural stones into a predetermined grain diameter. Consequently, the self-propelled crusher 1 is large in dimensions of entire length, entire width, and entire height, and therefore belongs to a large-sized self-propelled crusher.

The self-propelled crusher 1 is constituted of a main body unit 10 including a pair of base carriers 11, a supply unit 20 which is loaded on a rear side on the main body unit 10 and supplied with a raw material, a jaw crusher 30 loaded at a side in front of the supply unit 20, a power unit 40 loaded at a side further in front of the jaw crusher 30, and a discharge conveyor 50 extended diagonally upward to the front from between a pair of crawlers 18 under the main body unit 10.

The main body unit 10 includes a main frame (track frame) 14 in which a left and a right side frames 12 continuously provided in a longitudinal direction are connected with a plurality of connecting frames 13 (FIG. 2), and the base carrier 11 is mounted to a lower side of each of the side frames 12. The base carrier 11 is constituted such that the crawler 18 is wound around a sprocket 16 at a front portion, which is driven by a hydraulic motor 15, and an idler 17 at a rear portion.

The supply unit 20 includes a rear frame 23 in which a left and a right side frames 21 jutting rearward are connected with a substantially rectangular connecting frame 22 having an opening 22A. A grizzly feeder 24 is placed on a top portion of the rear frame 23 via a plurality of coil springs, and the grizzly feeder 24 is driven by vibratory equipment 25. A hopper 26 is provided on a top portion of the grizzly feeder 24 to enclose three sides around it, so that a raw material is charged into the hopper 26 expansively opened upward. A discharge chute 27 for introducing the raw material, which is selected by the grizzly and drops, to the discharge conveyer 50 below is provided at a lower portion of the grizzly feeder 24. In the hopper 26 of this embodiment, left and right wing portions 28 are provided to be foldable with respect to the main body part, and they are folded downward by detaching upper ends of supporting bars 29. This reduces entire height of the supply unit 20, and makes it possible to clear the limit of transportation with a trailer.

Figure 6:
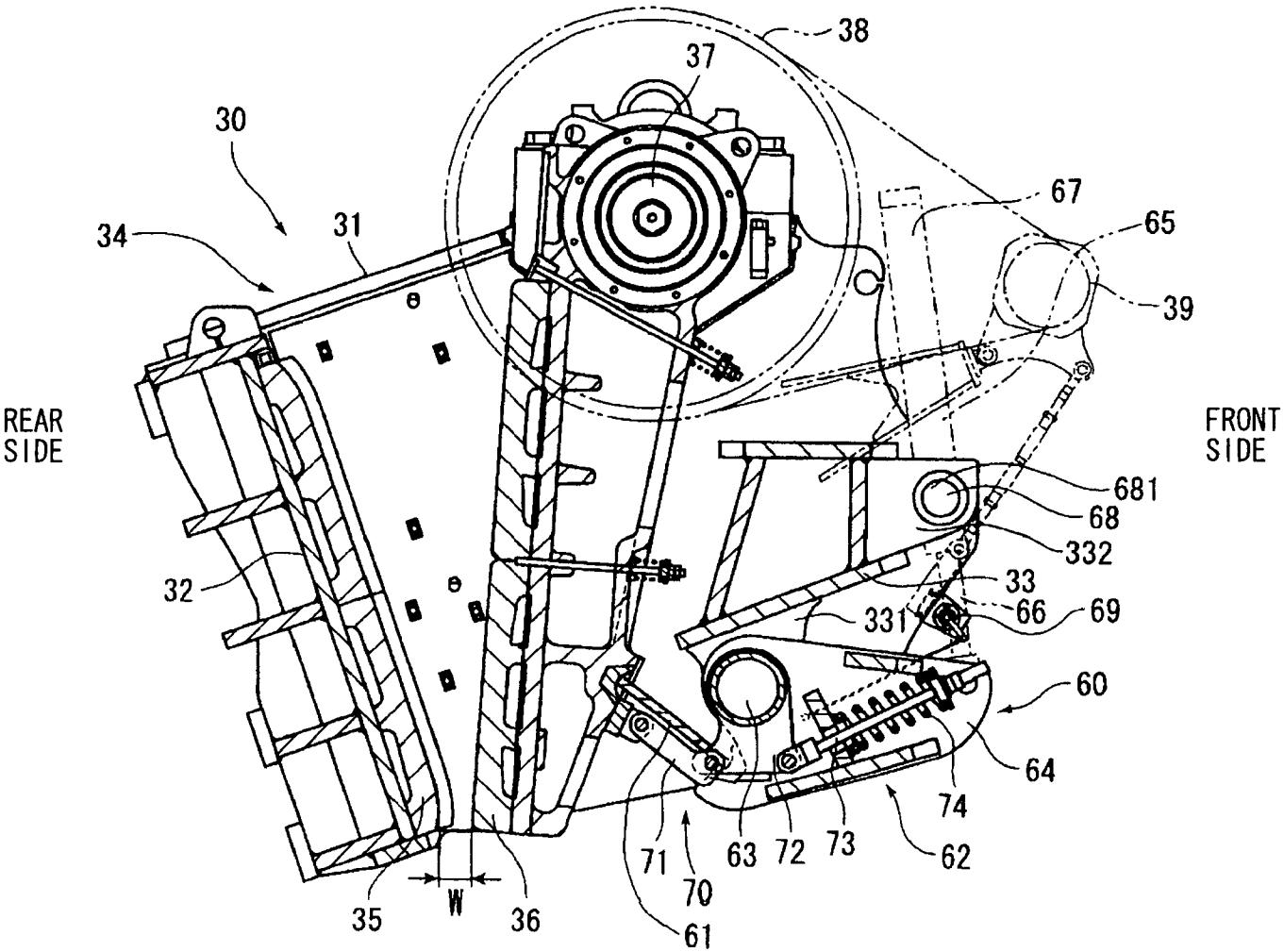
FIG. 6 is a sectional view showing a jaw crusher of the self-propelled crusher in FIG. 1.

The jaw crusher 30 includes a crusher frame (frame) 34 in which a left and right side wall plates 31 are connected with a back wall plate 32 reinforced with a plurality of ribs and a cross member 33, as shown in FIG. 6. In the jaw crusher 30, a fixed jaw 35 is mounted to an inner side of the back wall plate 32, and in front of the fixed jaw 35, disposed is a swing jaw 36 with a blade surface substantially vertical being close to the fixed jaw. In the swing jaw 36, its upper side is provided to suspend from an eccentric portion of a main shaft 37 rotatably provided between the side wall plates 31, and its lower portion side is supported at a reaction force receiving link mechanism 60 receiving a reaction force at the time of crushing and always biased to a side of the reaction force receiving link mechanism 60 by a tension link mechanism 70.

The reaction force receiving link mechanism 60 is mainly constituted of a toggle plate (connecting member) 61 of which one end is locked at a back surface portion of the swing jaw 36, and a toggle link (rotary member) 64 which supports the other end side of the toggle plate 61 and rotates around a fixed link pin 63, a lock cylinder (driving mechanism) 65 of which lower end is supported at the toggle link 64, and an angle sensor (angle detecting equipment) 69 for detecting a rotation angle of the toggle link 64. The lock cylinder 65 is rotatably supported at a side of the cross member 33 (trunnion structure). An outlet clearance W between lower ends of the jaws 35 and 36 can be adjusted by advancing and retreating a rod 66 of the lock cylinder 65. Namely, the reaction force receiving link mechanism 60 is an outlet clearance adjusting link mechanism (outlet clearance adjusting mechanism) 62, which moves the swing jaw 36 close to and away from the fixed jaw 35 via the toggle link 64 and the toggle plate 61 by drive of the lock cylinder 65.

A tension link mechanism 70 is disposed substantially at a center of the reaction force receiving link mechanism 60. The tension link mechanism 70 is mainly constituted of a tension link 71 of which one end is supported at a side of the swing jaw 36, a tension lever 72 rotatably supported at the fixed link pin 63, a tension rod 73 of which one end is supported at the tension lever 72, and a tension spring 74 for biasing the tension rod 73 in a predetermined direction. The tension rod 73 and the tension spring 74 are mounted to the toggle link 64.

In the jaw crusher 30 like this, a pulley 38 provided at one end of the main shaft 37 is driven by a hydraulic motor 39 via a V belt, whereby the swing jaw 36 functions as a swing link by rotation of the main shaft 37, and crushes a raw material in a space from the fixed jaw 35. On this occasion, in the jaw crusher 30 of this embodiment, the reaction force receiving link mechanism 60 is of an up thrust type so that the swing jaw 36 swings with respect to a blade surface of the fixed jaw 35 as if it was cutting off the blade surface from above to below.

A power unit 40 includes a base frame 42 in which a left and a right side frames 41 are connected with a plurality of connecting frames (not shown). An engine, a hydraulic pump, a fuel tank 43, an operating oil tank 44 and the like are mounted on the base frame 42 via suitable mounting brackets and cross members. A control valve for distributing hydraulic pressure from the hydraulic pump to the hydraulic motors of the base carriers 11, the vibratory equipment 25 of the grizzly feeder 24, the hydraulic motor 39 of the jaw crusher 30, a hydraulic motor for driving the discharge conveyor 50, and the like is housed inside a housing space enclosed by the base frame 42.

The discharge conveyor 52 has a rear portion located rearward from a discharge port at a lower end of the discharge chute 27, discharges an uncrushed raw material discharge from here and the crushed products dropped from an outlet port of the jaw crusher 30 forward, and drops them from a high location to allow them to be piled up or the like. When the raw material contains foreign matters such as reinforcing steel and metal pieces, it is possible to remove these foreign matters by mounting a magnetic separator to a front portion side of the discharge conveyor 50. Instead of piling the crushed products from the discharge conveyor 50 on the ground, they are sometimes transferred to a remote site by using a secondary conveyor, a tertiary conveyor and the like.

[Detailed Explanation of Jaw Crusher]

Details of the jaw crusher 30 will be explained below. In FIG. 6, the jaw crusher 30 includes the fixed jaw 35 fixed at the back wall plate 32 and the swing jaw 36 provided to oppose the fixed jaw 35 as mentioned above. At the back surface of the swing jaw 36, included are the reaction force receiving link mechanism 60 for receiving a reaction force of the swing jaw 36, and the tension link mechanism 70 for biasing the swing jaw 36 to the side of the reaction force receiving link mechanism 60 with a predetermined biasing force.

Figure 7:
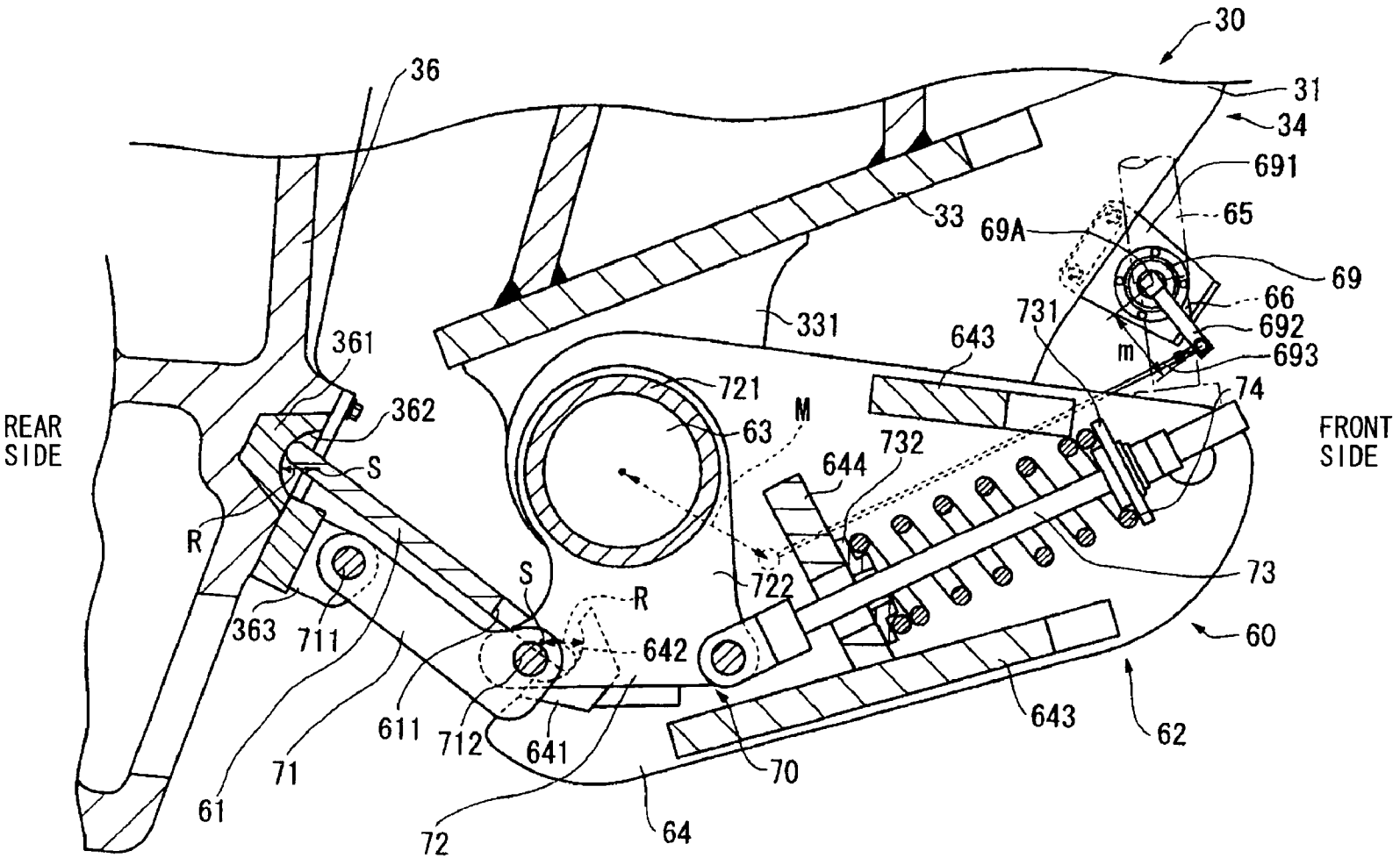
FIG. 7 is an enlarged sectional view showing an outlet clearance adjusting mechanism of the jaw crusher in FIG. 6.
Figure 8:
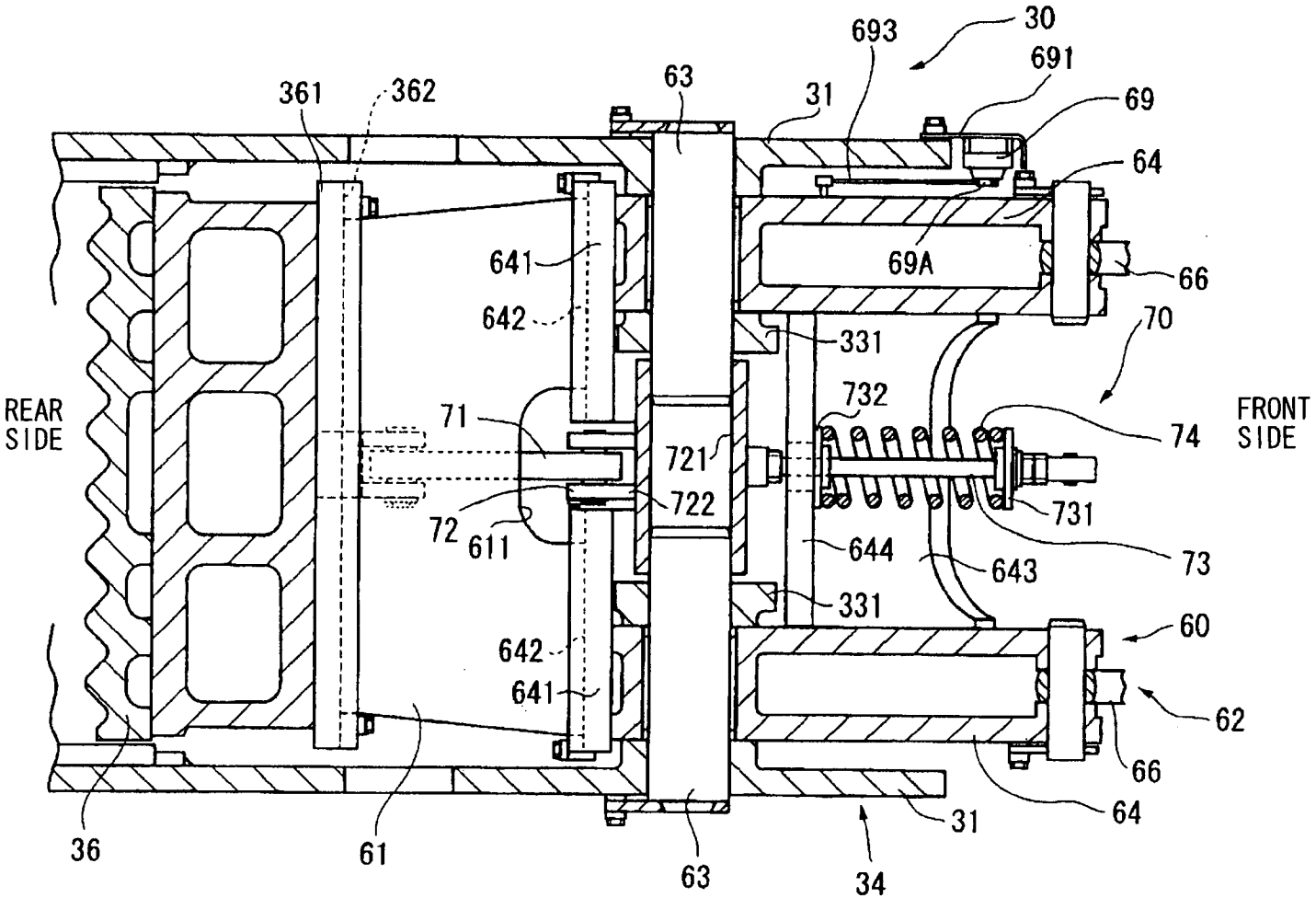
FIG. 8 is a plan cross sectional view showing the outlet clearance adjusting mechanism of the jaw crusher in FIG. 6.

The reaction force receiving link mechanism 60 is a link mechanism including the toggle plate 61, the toggle link 64, and the lock cylinder 65 as mentioned above, and includes the angle sensor 69 for detecting the rotation angle of the toggle link 64. The toggle plate 61 is a plate member which is made abut to the back surface of the swing jaw 36 over the entire width thereof, and is made abut to the swing jaw 36 in such a manner as to point upward from a diagonally lower side so that the reaction force receiving link mechanism 60 becomes of the up thrust type, as shown in FIG. 7 and FIG. 8. One end of the toggle plate 61 is made abut to an abutting portion 361 provided at the back surface of the swing jaw 36. The other end of the toggle plate 61 is made abut to an abutting portion 641 provided at the toggle link 64. Due to this, the toggle plate 61 is sandwiched between the swing jaw 36 and the toggle link 64. Recessed portions 362 and 642 each in a substantially circular arc recessed shape in section with radius R (the arrow in FIG. 7) are formed on the abutting portions 361 and 641, and the toggle plate 61 is swingable with arc centers of the recessed portions 362 and 642 as swing centers S. At a center in a width direction of the toggle plate 61, a notch portion 611 is formed at a side near to the toggle link 64.

Two of the toggle link 64 are provided in the vicinity of an inner side of the side wall plate 31, and are connected by a connecting portion 643 integrally spanned between these toggle links 64. A mounting portion 644 to which the tension spring 74 is mounted is integrally formed at the connecting portion 643. These toggle links 64 are respectively supported at the fixed link pins 63, two of the fixed link pins 63 are provided on the same axis inside the side wall plates 31, and respective spaced one ends are fixed to the side wall plates 31, while the other ends close to each other are fixed to mounting plates 331 protruded downward from the cross members 33. The abutting portions 641 are respectively mounted to the toggle links 64, and end portion of the toggle plate 61 at both sides of the notch portion 611 abuts thereto.

The lock cylinders 65 are respectively provided at a front side of two of the toggle links 64, and include rods 66 and cylinder main bodies 67 for advancing and retreating the rods 66, as shown in FIG. 6. The lock cylinder 65 is vertically provided so that the rod 66 is at a lower side of the cylinder main body 67, and a lower end of the rod 66 is supported at an end portion at a front side of the toggle link 64. In the cylinder main body 67, a portion in the vicinity of an end portion at a side where the rod 66 advances and retreats, namely, a lower end side (head side) is rotatably supported by a supporting portion 68 of the trunnion structure. The supporting portion 68 includes a supporting shaft 681 integrally formed to be protruded from both sides of the cylinder main body 67, and a bearing portion (not shown) for rotatably supporting the supporting shaft 681. One end of the supporting shaft 681 is supported at the side wall plate 31 and the other end thereof is supported at a mounting plate 332 provided to be protruded from the cross member 33, whereby the lock cylinder 65 is disposed at a position close to the side wall plate 31.

In the above lock cylinder 65, the rod 66 or a piston at an end portion of the rod 66 is press-fitted in a space from the cylinder main body 67, and both of them are usually locked. If hydraulic pressure is introduced into a press-fitted portion through the rod 66, the circumferential wall of the cylinder main body 67 swells outward, whereby resistance of both of them is reduced to release lock, and the rod 66 is enabled to advance to and retreat from the cylinder main body 67. Accordingly, the rod 66 can be locked at any optional position inside the cylinder main body 67.

The angle sensor 69 is mounted to one of the side wall plates 31 via a mounting member 691. The mounting member 691 is fastened at an outer side of the side wall plate 31 with a bolt, and its tip end side is formed in a substantially L-shape in section bended toward an inside. The angular sensor 69 is mounted at an inner side of the mounting member 691, whereby it is protected from dust and the like. One end of a first link member 692 is fixed to an angle detecting rotary shaft 69A of the angle sensor 69, one end of a second link member 693 is rotatably connected to the other end of the first link member 692, and the other end of the second link member 693 is rotatably mounted to the toggle link 64. Thus, the angle sensor 69 is connected to the toggle link 64 with a link.

Here, a length m of the first link member 692 is shorter than a distance M from a center of the fixing link pin 63 to the mounting position of the second link member 693 to the toggle link 64, and the length m is about ½ times as long as the distance M in this embodiment. As for the angle sensor 69, an optional sensor such as a potentiometer and a rotary encoder can be adopted.

According to the above reaction force receiving link mechanism 60, a reaction force occurring at a time of crushing a raw material is received by the fixing link pin 63 of the toggle link 64 and the supporting portion 68 of the lock cylinder 65 via the toggle plate 61. If hydraulic pressure is introduced to between a piston and the cylinder main body 67 of the lock cylinder 65 to release the lock, and the rod 66 is advanced and retreated in this state, as mentioned above, the swing jaw 36 is moved via the toggle link 64 and the toggle plate 61 and moved close to and away from the fixed jaw 35. Namely, the reaction force receiving link mechanism 60 also serves as the outlet clearance adjusting link mechanism 62.

The tension link mechanism 70 is provided substantially in a center in a width direction of the swing jaw 36, between the two toggle links 64 as shown in FIG. 7 and FIG. 8. The tension link mechanism 70 is such a link mechanism as includes the tension link 71, the tension lever 72, the tension rod 73 and the tension spring 74.

The tension link 71 is substantially in an L-shape, with one end thereof being supported at a rotary center shaft 711 of the mounting portion 363 provided at the swing jaw 36 and the other end thereof being supported at a rotary center shaft 712 of the tension lever 72, and is swingable with substantially the centers of these rotary center shafts 711 and 712 as swing centers. A side near to the tension lever 72, of an end portion of the tension link 71 is disposed at an inner side of the notch portion 611 of the toggle plate 61 so that it does not interfere with the toggle plate 61. The rotary center shafts 711 and 712 are provided in the vicinities of the swing centers S of the toggle plate 61, and the tension link 71 performs a swing operations closely analogous to the swing operation of the toggle plate 61.

The tension lever 72 includes a shaft portion 721 rotatably supported at the fixing link pin 63, and a lever portion 722 which rotates around the shaft portion 721. The shaft portion 721 is formed in a cylindrical shape, and its both ends are supported between end portions of the fixed link pins 63 at sides at which the fixed link pins 63 are close to each other. A pair of the lever portions 722 are vertically provided at a lower side of the shaft portion 721, the tension link 71 is mounted to a rear side of a lower end side of the lever portion 722, and an end portion of the tension rod 73 is mounted to a front side thereof.

The tension rod 73 penetrates through the mounting portion 644 of the toggle link 64 and is disposed from the mounting portion of the tension lever 72 diagonally upward to the front. The tension rod 73 is inserted through the tension spring 74. The tension spring 74 has its tip end abutted by an abutting portion 731 screwed onto the tension rod 73, and its base end abutted by an abutting portion 732 fixed to the mounting portion 644, thereby biasing the tension rod 73 with a predetermined biasing force (tensile force) with respect to the toggle link 64. Namely, the tension spring 74 biases the swing jaw 36 to the side of the toggle link 64 via the tension rod 73, the tension lever 72 and the tension link 71. By this biasing force, the toggle plate 61 is reliably held between the swing jaw 36 and the toggle link 64.

[Operation of Jaw Crusher]

An operation of the jaw crusher 30 will be explained below. First, the main shaft 37 is rotated by rotating the pulley 38 via the V belt by the drive of the hydraulic motor 39, whereby the swing jaw 36 supported at the eccentric portion of the main shaft 37 swings. In this situation, the lower side of the swing jaw 36 is supported by the up thrust type of reaction force receiving link mechanism 60, and therefore the toggle plate 61 swings around the swing center S at the side of the toggle link 64. As a result, the swing jaw 36 swings close to and away from the fixed jaw. By this swing movement, the swing jaw 36 and the fixed jaw 35 crush a raw material charged between them and discharge the crushed products to the discharge conveyor 50 from the outlet clearance W between the lower ends thereof.

The reaction force exerted on the swing jaw 36 while crushing a raw material is received by the fixing link pin 63 of the toggle link 64 and the supporting portion 68 of the lock cylinder 65 via the toggle plate 61. When the reaction force exerted on the swing jaw 36 is excessively large, the press-fitted portion of the lock cylinder 65 slides, whereby damages to the toggle link 64, the toggle plate 61 and the main shaft 37 are prevented.

Meanwhile, when the grain size of the crushed product is to be changed, the outlet clearance adjusting link mechanism 62 is operated. Hydraulic pressure is introduced to between the piston and the cylinder main body 67 of the lock cylinder 65 to slightly expand the cylinder main body 67 to reduce the resistance of both of them, and locking by press-fitting is released. When the hydraulic pressure is introduced to the head side or the bottom side of the cylinder main body 67 to advance and retreat the rod 66 in this state, the toggle link 64 is rotated around the fixed link pin 63 following this. Thereupon, the toggle plate 61 is moved, and the swing jaw 36 is moved close to and away from the fixed jaw 35, thereby adjusting the outlet clearance W between the lower ends of the swing jaw 36 and the fixed jaw 35 to change the grain size of the crushed product.

In this situation, the outlet clearance W is detected by detecting the rotation angle of the toggle link 64 by the angle sensor 69. Namely, when the toggle link 64 is rotated on the occasion of the outlet clearance adjustment, the second link member 693 is moved together to move the first link member 692. The length m of the first link member 692 is about ½ times as long as the distance M from the center of the fixing link pin 63 to the mounting position of the second link member 693 to the toggle link 64, and therefore the first link member 692 rotates at an angle about twice as large as the rotation angle of the toggle link 64. Accordingly, the rotation angle of the toggle link 64 is detected by being amplified to double the rotation angle.

In the tension link mechanism 70, as the swing jaw 36 moves close and away, the tension link 71 is also moved to rotate the tension lever 72. Since each of the swing centers of the tension link 71 is in the vicinity of the each of the swing centers S of the toggle plate 61 and the rotation centers of the tension lever 72 and the toggle link 64 are at the common fixed link pin 63 in this situation, a moving locus of the tension link 71 is closely analogous to a moving locus of the toggle plate 61. Accordingly, the tension lever 72 rotates at substantially the same angle as the rotation angle of the toggle link 64. As a result, the relative position of the abutting portion 731 of the tension rod 73 mounted to the tension lever 72 and the abutting portion 732 fixed to the mounting portion 644 of the toggle link 64 hardly changes, and therefore the biasing force of the tension spring 74 is substantially constant even when the outlet clearance W is changed.

Accordingly, the following effects can be obtained according to this embodiment.

(1) Since the angle sensor 69 is mounted to the side wall plate 31, a repeated reaction force from the swing jaw 36, an impact and the like at the time of crushing are not directly exerted on the angle sensor 69. Accordingly, unlike the conventional case in which the angle sensor is mounted to the toggle link 64, the angle sensor 69 hardly receives a vibration of the toggle link 64 by the reaction force and the like from the swing jaw 36, and thus, stable angle detection can be performed.

(2) The angle sensor 69 is connected to the toggle link 64 by the link constituted by including the first link member 692 and the second link member 693. Consequently, the rotation angle of the toggle link 64 can be easily amplified by properly setting the distance M from the fixed link pin 63 to the mounting position of the second link member 693 to the toggle link 64, the length m of the first link member and the like. Since the rotation angle of the toggle link 64 can be more accurately detected by amplifying the rotation angle of the toggle link 64 and detecting it, a crushed product of a desired grain size can be obtained and fine-tuning can be easily performed. Consequently, high resolution can be obtained even with an angle sensor at a low price, and therefore the jaw crusher 30 can be manufactured at low cost.

(3) The outlet clearance W is adjusted by detecting the rotation angle of the toggle link 64 with the angle sensor 69. Consequently, if zero point adjustment is performed by, for example, making the swing jaw 36 abut to the fixed jaw before adjustment, detecting the abutment by a change in the hydraulic pressure for operation exerted on the head side or the bottom side of the lock cylinder 65, and the like, the outlet clearance W can be accurately adjusted irrespective of abrasion amounts of the swing jaw 36 and the fixed jaw 35. On the other hand, after a use for a predetermined period of time, the swing jaw 36 is made abut to the fixed jaw 35 again, and the detected angle of the angle sensor 69 at this time is confirmed, whereby the sum of the abrasion amounts of the swing jaw 36 and the fixed jaw 35 can be detected.

(4) The rotation angle of the toggle link 64 can be detected with the angle sensor 69. Consequently, if a detection signal of, for example, the angle sensor 69 is transmitted to control means for controlling the operation of the jaw crusher 30 such as the lock cylinder 65 and the swing jaw 36, and the hydraulic pressure fed to the lock cylinder 65 is adjusted while the detection signal is being monitored, the outlet clearance W can be automatically adjusted.

The present invention is not limited to the aforesaid embodiment, and the present invention includes various modifications, improvements and the like within the scope where the object of the present invention can be attained. An amplification factor of the rotation angle of the toggle link 64 is set to be about double according to the length of the first link member 692 and the mounting position of the second link member 693. However, this is not restrictive, and, for example, the length m of the first link member 692 may be set longer than the distance M from the fixed link pin 63 to the mounting position of the second link member 693 to the toggle link 64. In short, the amplification factor may be properly set at an optional amplification factor by adjusting the length m of the first link member 692 and the distance M from the fixed link pin 63 to the mounting position of the second link member 693 to the toggle link 64.

Figure 9:
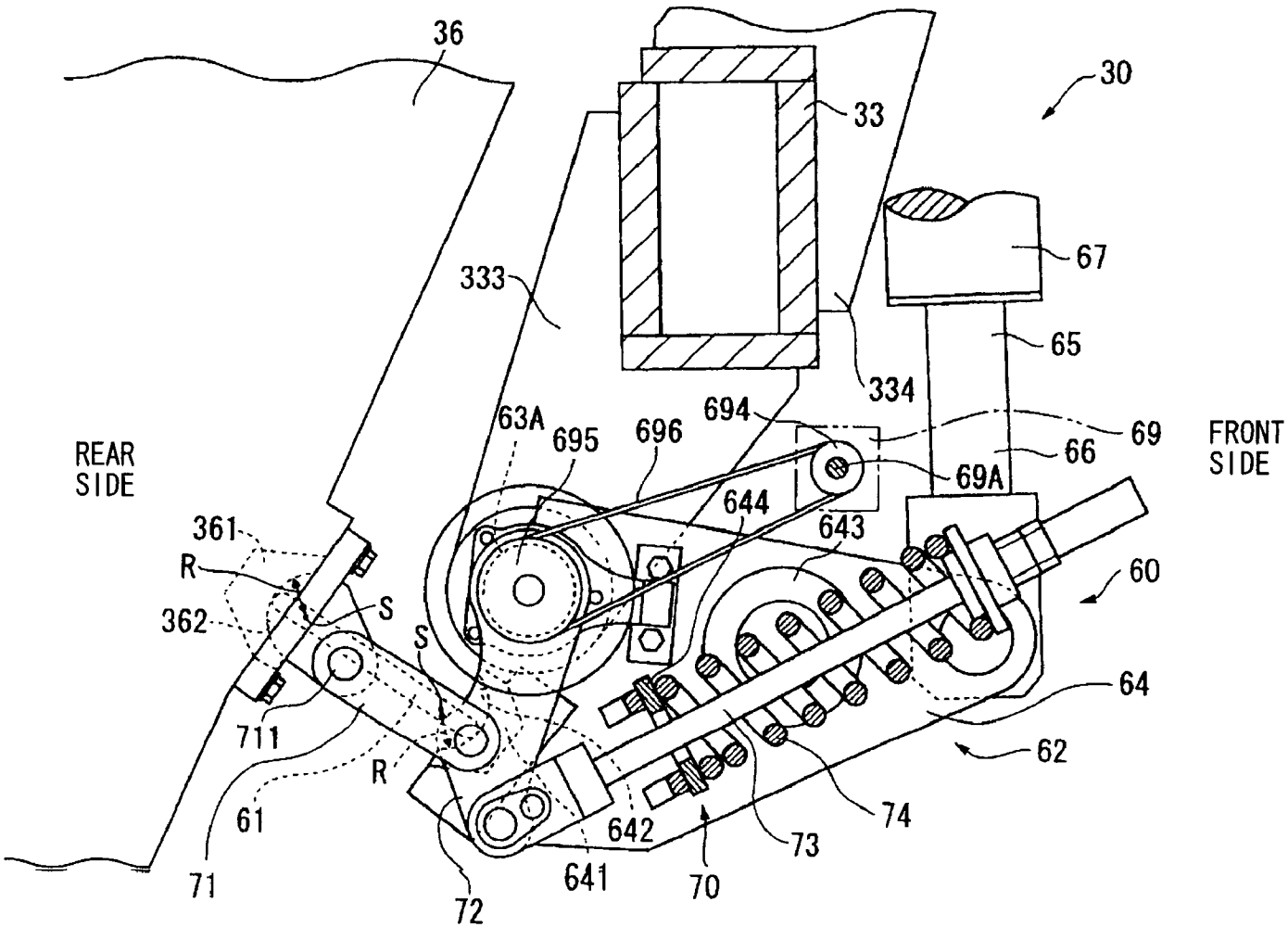
FIG. 9 is an enlarged sectional view showing a modified example of a mounting structure of angle detecting equipment in the one embodiment.
Figure 10:
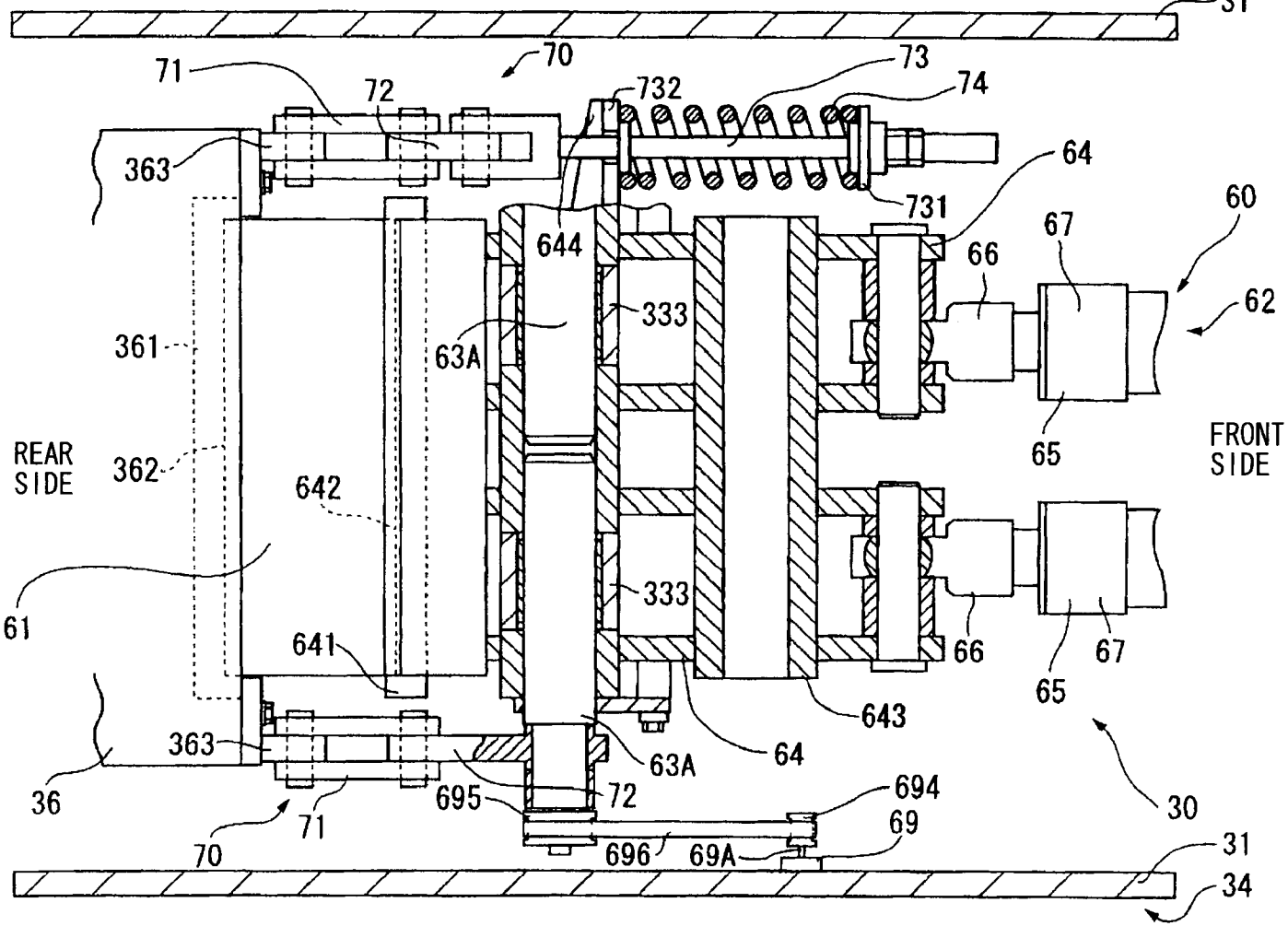
FIG. 10 is a plan cross sectional view of the mounting structure in FIG. 9.

The toggle link 64 is rotatably supported at the fixed link pin 63, but this is not restrictive, and the toggle link 64 may be fixed at a link pin 63A as shown in FIG. 9 and FIG. 10. In FIG. 9 and FIG. 10, a pair of the tension link mechanisms 70 are provided at both sides of the toggle plate 61. The toggle links 64 are disposed close to each other, and they are connected with a cylindrical connecting portion 643. The toggle links 64 are fixed to the link pins 63A, whereby the link pins 63A are rotated with the toggle links 64. Each of the link pins 63A is rotatably supported substantially at a center by a mounting portion 333 provided to protrude downward from the cross member 33.

The tension lever 72 is supported to be individually rotatable with respect to the link pin 63A, and the tension rod 73 is supported at a mounting portion 644 provided to protrude from the toggle link 64 via the tension spring 74. The lock cylinder 65 is rotatably supported at a mounting portion 334 protruded upward from the cross member 33, at a side far from the rod 66, of the cylinder main body 67, namely, a bottom side. With the outlet clearance adjusting mechanism 62 of such a structure, the toggle link 64 is also rotated with the link pin 63A, and therefore the rotation angle of the toggle link 64 can be detected.

In the structure in FIG. 9 and FIG. 10, the mounting structure of the angle sensor 69 is not limited to the link in the aforementioned embodiment, but it may be by a pulley and a belt, for example. The angle sensor 69 is fixed inside the side wall plate 31, and a first pulley 694 is fixed to an angle detecting rotary shaft 69A. Meanwhile, a second pulley 695 is fixed to the link pin 63A, and a belt 696 is attached to these pulleys 694 and 695. In this situation, a diameter of the first pulley is about ½ times as large as a diameter of the second pulley 695.

In such a mounting structure, the link pin 63A is rotated together when the toggle link 64 is rotated, and the second pulley 695 is rotated. The rotation is transmitted to the first pulley 694 by the belt 696, and it is amplified to be substantially doubled by the first pulley 694, and detected by the angle sensor 69. As for the pulleys 694 and 695 and the belt 696, optional shapes such as a flat pulley and a flat belt, a V pulley and a V belt can be adopted. The rotation angle of the toggle link 64 can be optionally amplified by properly setting the diameters of the pulleys 694 and 695.

In the structure in which the link pin 63A is fixed to the toggle link 64, the toggle link 64 and the angle sensor 69 may be connected with a link. Since the link pin 63A is rotated with the toggle link 64 on this occasion, a link mechanism may be constituted by providing, for example, another link member, then fixing one end of this link member to the link pin 63A, and rotatably connecting the other end thereof to an end portion of the second link member 693. In this case, the amplification factor of the rotation angle can be optionally set by properly setting the length of the link member fixed to the link pin 63A and the length of the first link member 692.

The reaction force receiving mechanism 60 is of an up thrust type in which the toggle plate 61 faces upward to abut to the swing jaw 36 from a diagonally lower side, but this is not restrictive, and it may be of a down thrust type. Namely, the toggle plate 61 may face downward to abut to the swing jaw 36 from a diagonally upper side, and the swing jaw 36 may swing from a lower side to an upper side when the swing jaw 36 moves close to the fixed jaw 35.

Figure 11:
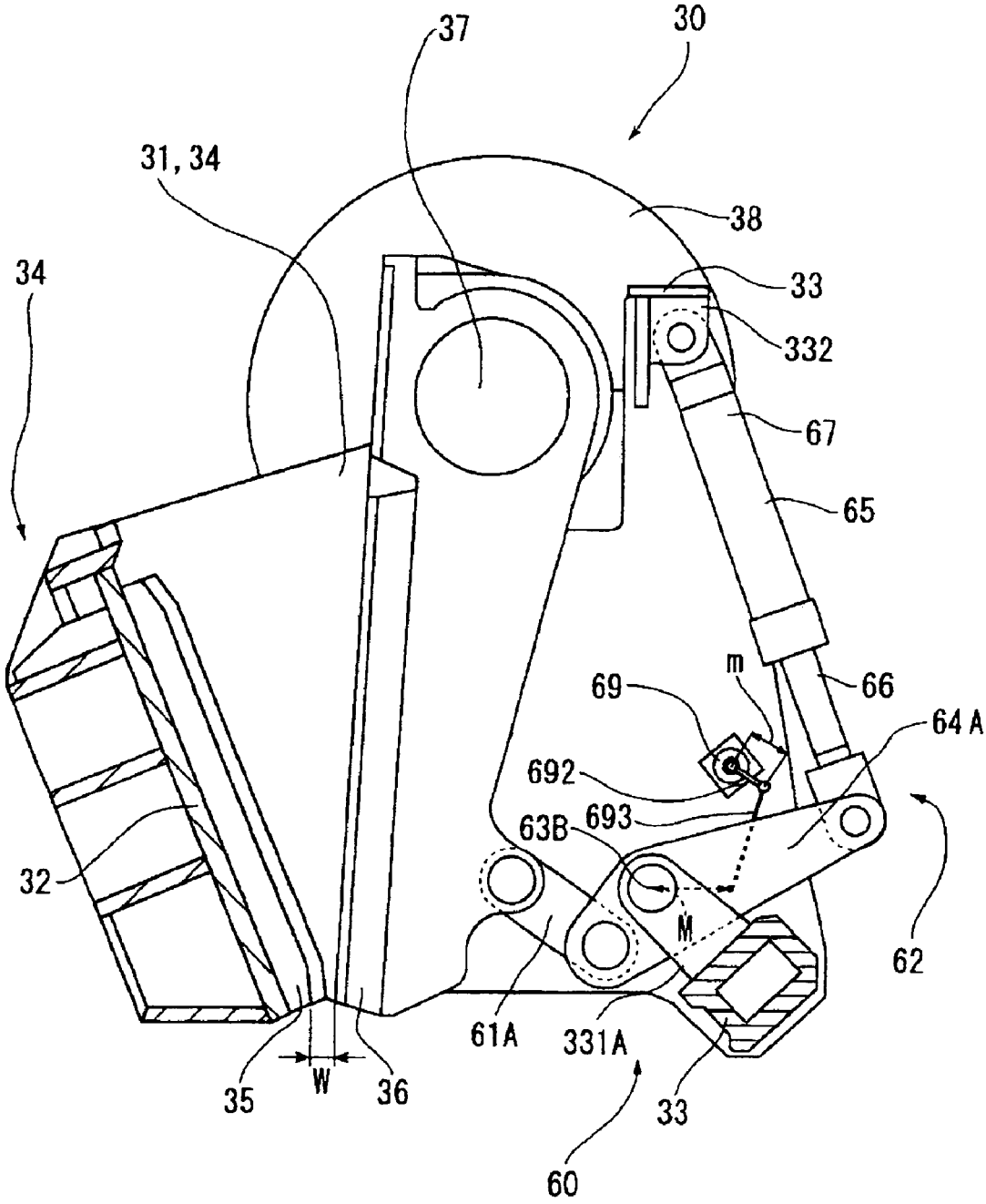
FIG. 11 is a sectional view showing a modified example of an outlet clearance adjusting mechanism in the one embodiment.

The outlet clearance adjusting link mechanism 62 is such that the toggle plate 61 abuts to between the swing jaw 36 and the toggle link 64 in this embodiment, but this is not restrictive, and it may be the one using a link of which one end is connected to the swing jaw 36 and of which other end is connected to the toggle link 64. In this case, as shown in FIG. 11, the outlet clearance adjusting link mechanism 62 includes a connecting member 61A of which one end is connected to the swing jaw 36, a rotary member 64A to which the other end of the connecting member 61A is connected, and the lock cylinder 65 of which rod 66 is mounted to the rotary member 64A. The rotary member 64A is supported rotatably around a rotary shaft 63B, one end of the rotary shaft 63B is supported at the side wall plate 31, and the other end thereof is supported at a mounting plate 331A protruded from the cross member 33. The lock cylinder 65 is rotatably supported at a mounting plate 332A, which is protruded from the side wall plate 31 and the cross member 33, at a tip end side of the cylinder main body 67, namely, at the bottom side.

The angle sensor 69 is fixed to the side wall plate 31, and the end portion of the second link member 693 is rotatably mounted to the rotary member 64A. In the outlet clearance adjusting link mechanism 62 like this, when the rod 66 of the lock cylinder 65 is advanced and retreated, the rotary member 64A is rotated and the swing jaw 36 is moved, thereby also making it possible to adjust the outlet clearance W. Since the angle sensor 69 is mounted to the side wall plate 31, the rotary member 64A does not directly receive repeated reaction force exerted from the swing jaw 36, and stable angle detection can be performed on this occasion. The jaw crusher 30 is mounted on the self-propelled crusher 1 in this embodiment, but this is not restrictive, and it may be utilized as a stationary crusher.

The best constitution, method and the like for carrying out the present invention are disclosed in the above description, but the present invention is not limited to them. Namely, the present invention is particularly illustrated and explained mainly concerning the specific embodiment, but the person skilled in the art can add various modifications to the embodiment mentioned above in the shape, material, number and amount, and the other detailed constitutions without departing from the scope of the technical idea and object of the present invention. Consequently, the description limiting the shape, material and the like disclosed in the above is only the exemplificative description to facilitate understanding of the present invention, and does not limit the present invention, and therefore the description in the names of the members with part of the limitation or the whole of the limitation of their shapes, materials and the like being excluded is included in the present invention.

What is claimed is:

1. A jaw crusher comprising:

a fixed jaw;

a swing jaw provided to oppose said fixed jaw;

a frame for supporting said fixed jaw and said swing jaw; and an outlet clearance adjusting mechanism for adjusting an outlet clearance between said fixed jaw and said swing jaw, wherein said outlet clearance adjusting mechanism comprises:

a connecting member including a first end that abuts against or is connected to said swing jaw;

a rotatable rotary member that abuts against or is connected to a second end of said connecting member;

a driving mechanism for rotating said rotary member; and an angle detecting unit which is mounted to said frame and detects a rotation angle of said rotary member;

wherein said angle detecting unit is connected to said rotary member with a link.

2. The jaw crusher according to claim 1, wherein said link comprises a first link member connected to the angle detecting unit and a second link member connecting the first link member to said rotary member.

3. The jaw crusher according to claim 2, wherein said rotary member rotates around a pin, and a length of the first link member is substantially equal to one half of a distance from a center of said pin to a connecting point of the second link member onto said rotary member.

4. A jaw crusher, comprising:

a fixed jaw;

a swing jaw provided to oppose said fixed jaw;

a frame for supporting said fixed jaw and said swing jaw; and an outlet clearance adjusting mechanism for adjusting an outlet clearance between said fixed jaw and said swing jaw, wherein said outlet clearance adjusting mechanism comprises:

a connecting member including a first end that abuts against or is connected to said swing jaw;

a rotatable rotary member that abuts against or is connected to a second end of said connecting member;

a driving mechanism for rotating said rotary member; and an angle detecting unit which is mounted directly to said frame and detects a rotation angle of said rotary member.

* * * * *